US008147387B2

(12) United States Patent
Martin

(10) Patent No.: US 8,147,387 B2
(45) Date of Patent: Apr. 3, 2012

(54) MUSCLE EXERCISE DEVICES AND ASSOCIATED METHODS

(75) Inventor: James Charles Martin, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 12/568,473

(22) Filed: Sep. 28, 2009

(65) Prior Publication Data

US 2010/0035732 A1 Feb. 11, 2010

(51) Int. Cl.
*A63B 22/06* (2006.01)
*A63B 22/12* (2006.01)
*A63B 69/16* (2006.01)

(52) U.S. Cl. ..... 482/57; 482/63

(58) Field of Classification Search ..... 482/51–52, 482/57, 62–63, 70–71, 79–80, 92–94, 97–98; *A63B 22/06, 22/12, 69/16*
See application file for complete search history.

(56) References Cited

U.S. PATENT DOCUMENTS 3,771,785 A * 11/1973 Speyer ..... 482/106
4,867,441 A * 9/1989 Blakeman ..... 482/57
4,973,046 A * 11/1990 Maxwell ..... 482/60
5,002,298 A * 3/1991 Motto ..... 280/233
5,142,938 A * 9/1992 Sampson ..... 74/594.6
5,449,332 A * 9/1995 Hervig ..... 482/57
5,901,617 A * 5/1999 Hervig ..... 74/594.4
6,003,408 A * 12/1999 Hervig ..... 74/594.4
6,241,639 B1 * 6/2001 Hervig ..... 482/57
6,390,488 B1 * 5/2002 Wallingsford ..... 280/291
6,730,003 B1 * 5/2004 Phillips ..... 482/57
6,878,102 B1 * 4/2005 Commisso ..... 482/79
2009/0163331 A1 * 6/2009 Lacher ..... 482/98

* cited by examiner

*Primary Examiner* — Loan Thanh
*Assistant Examiner* — Oren Ginsberg
(74) *Attorney, Agent, or Firm* — Thorpe North & Western LLP

(57) ABSTRACT

A muscle exercise device can include a crank having an axis of rotation. A first arm can be connected to the crank so that a downward external force applied to the distal end of the first arm causes rotation of the crank. The devices of the present invention can further include a second arm to which a counterweight is connected. Optionally, an assist mechanism other than a counterweight can be used to provide upward movement of the first arm with minimal application of force by a subject. A retrofit kit can be provided for modifying an existing device such as an ergometer or road bicycle. The retrofit kit can include a counterweight and a fastener for attaching to the device to the existing device. The devices of the present invention allow for increased exercise capacity, isolation of muscle groups, and biomechanical forces which closely approximate comparable paired limb motion.

15 Claims, 5 Drawing Sheets

MUSCLE EXERCISE DEVICES AND ASSOCIATED METHODS

RELATED APPLICATIONS

This application claims the benefit of U.S. Provisional Application No. 60/794,662, filed Apr. 24, 2006, U.S. Provisional Application No. 60/875,216, filed Dec. 15, 2006 and U.S. Non-provisional application Ser. No. 11/789,707, filed Apr. 24, 2007, each of which are incorporated herein by reference.

BACKGROUND AND SUMMARY OF THE INVENTION

Ventilatory patterns change during exercise in response to the increased oxygen demands of muscles and other tissues. Such changes are transient, and largely disappear once the metabolism slows down and any oxygen debt is repaid. Persisting with a regimen of moderate exercise, however, can cause more lasting physiological changes, including an increased capacity for oxygen metabolism in muscle groups exercised and an enhanced ability of the circulatory system to deliver oxygen to those muscle groups. Increased respiratory capacity of muscles from exercise is a direct response to increased rate of oxygen delivery to those muscles. During exercise the amount of oxygen taken up by the blood from the respiratory system must be distributed among various muscle groups according to their level of activity. Therefore the degree to which heavy activity can be focused to fewer muscle groups at a given maximum rate of oxygen uptake ($VO_2$max), those muscles will experience a higher rate of oxygen delivery.

A number of applications can benefit from more effective and efficient modes of aerobic exercise. One is rehabilitative exercise for patients suffering the effects of congestive heart failure, vascular disease, and obstructive pulmonary disease. Often these patients have severely reduced exercise capacity and exhibit low $VO_2$max values. Such low oxygen delivery cannot allow paired-limb exercise of sufficient intensity to provide an up-regulation of muscle aerobic capacity. This is particularly important to the prognosis of chronic heart failure patients, whose chances of surviving a heart transplant can be greatly increased by an increase in ventilatory threshold (an indicator of metabolic stress in skeletal muscle). Another application for which intensity of exercise is important is the training of endurance athletes. Exercise that produces greater gains in single leg ventilatory threshold would allow endurance athletes to perform for prolonged periods at close to $VO_2$max without experiencing metabolic stress in skeletal muscle.

Applications such as these, point to a need for methods of exercise that isolate muscle groups such as those in a single limb. Also needed are devices that can facilitate such exercise. Many aerobic exercise methods are useful for concentrating a subject's exertions to certain muscle groups. Among the most effective methods for generating sustained aerobic activity are those that approximate locomotion. However such methods and the devices that implement them typically involve paired-limb activity. In this type of exercise the total oxygen uptake, less that required for other body processes, is more or less equally divided between two limbs. Therefore the maximum delivery rate experienced by each limb can only approach one-half of $VO_2$max. To provide maximum gains in respiratory capacity, it has been recognized by the present inventors that it would be preferable to exercise each individual limb in isolation. In this way, each limb can receive oxygen at a rate much closer to $VO_2$max, which can result in a greater adaptive response by the muscles of that limb.

Accordingly, the present invention provides a cardiovascular and muscle exercise device including a crank having an axis of rotation. A first arm can be connected to the crank and can be configured so that a downward external force applied to the distal end of the first arm causes rotation of the crank. The devices of the present invention can further include a second arm to which a counterweight is connected and configured such that the force applied by the counterweight causes rotation of the crank. In accordance with a more detailed aspect of the present invention, the device can include a brake. Another aspect of the invention includes a shield configured to prevent the counterweight from striking the subject during exercise.

In one embodiment of the invention the device can be a bicycle trainer or a retrofit bicycle trainer. In another aspect of the present invention a retrofit kit can be provided for modifying an existing device in order to accomplish the purposes of the present invention. The retrofit kit can include a counterweight and a fastener for attaching to the device.

The invention also provides a method of exercising musculature associated with a single limb, comprising the steps of applying a downward force to an arm operatively connected to a crank so that the arm moves from an upper position to a lower position. The crank can then be allowed to continue rotating so that the arm returns to the upper position. The return portion of the cycle is arranged such that the return movement is assisted by a counterweight.

Additional features and advantages of the invention will be apparent from the detailed description which follows, which illustrates, by way of example, features of the invention.

DETAILED DESCRIPTION

Figure 1:
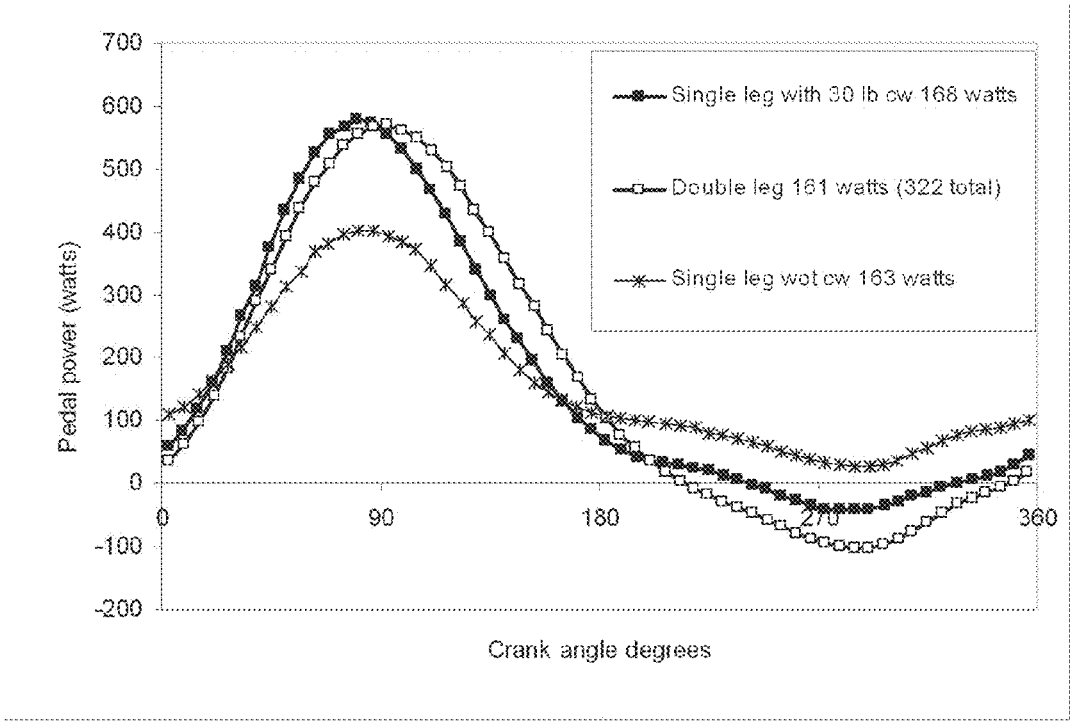
FIG. 1 is a graph of power applied to a crank arm versus crank angle during a cycle of rotation for paired-limb and single-leg pedaling on a conventional exercise bicycle and single-leg pedaling in which a 30 lb. counterweight is attached to the opposite crank-arm in accordance with an embodiment of the present invention.

Reference will now be made to exemplary embodiments of the present invention, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

A. Definitions

The singular forms "a," "an," and "the" include plural referents unless the context clearly dictates otherwise.

As used herein, "subject" refers to a human or an animal, such as a mammal, that can utilize and benefit from the devices and methods disclosed. Most often, the subject will be a human.

The term "axle" refers to a shaft made of rigid material, having an axis of rotation that is parallel to the shaft length and passes through its center and each end. Generally, the axle is positioned in a housing that supports the shaft and allows it to rotate on the axis of rotation. An axle can be a solid body, or can be partially or completely hollow.

As used herein, the term "limb" refers to an appendage that extends from the axial skeleton of a vertebrate, and incorporates an articulated skeletal structure with musculature for moving the appendage through at least one degree of freedom. When used with regard to limbs, the term "extension" refers to a movement or sequence of movements of the limb that tends to straighten it or to move a portion of the limb away from the axial skeleton, while the term "flexion" refers to a movement or sequence of movements that tend to bend the limb or bring it closer to the axial skeleton.

As used herein, the term "power curve" is a graph of power (usually in watts) versus rotational angle (i.e. 0° through 360°) as applied to an axle of an exercise device.

The term "about" when referring to a numerical value or range is intended to encompass the values resulting from experimental error that can occur when taking measurements and explicitly includes the exact numerical value as if such were independently recited, unless otherwise noted.

As used herein, a plurality of items, structural elements, and/or materials can be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Weights, distances, and other numerical data can be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

B. Invention

Figure 3:
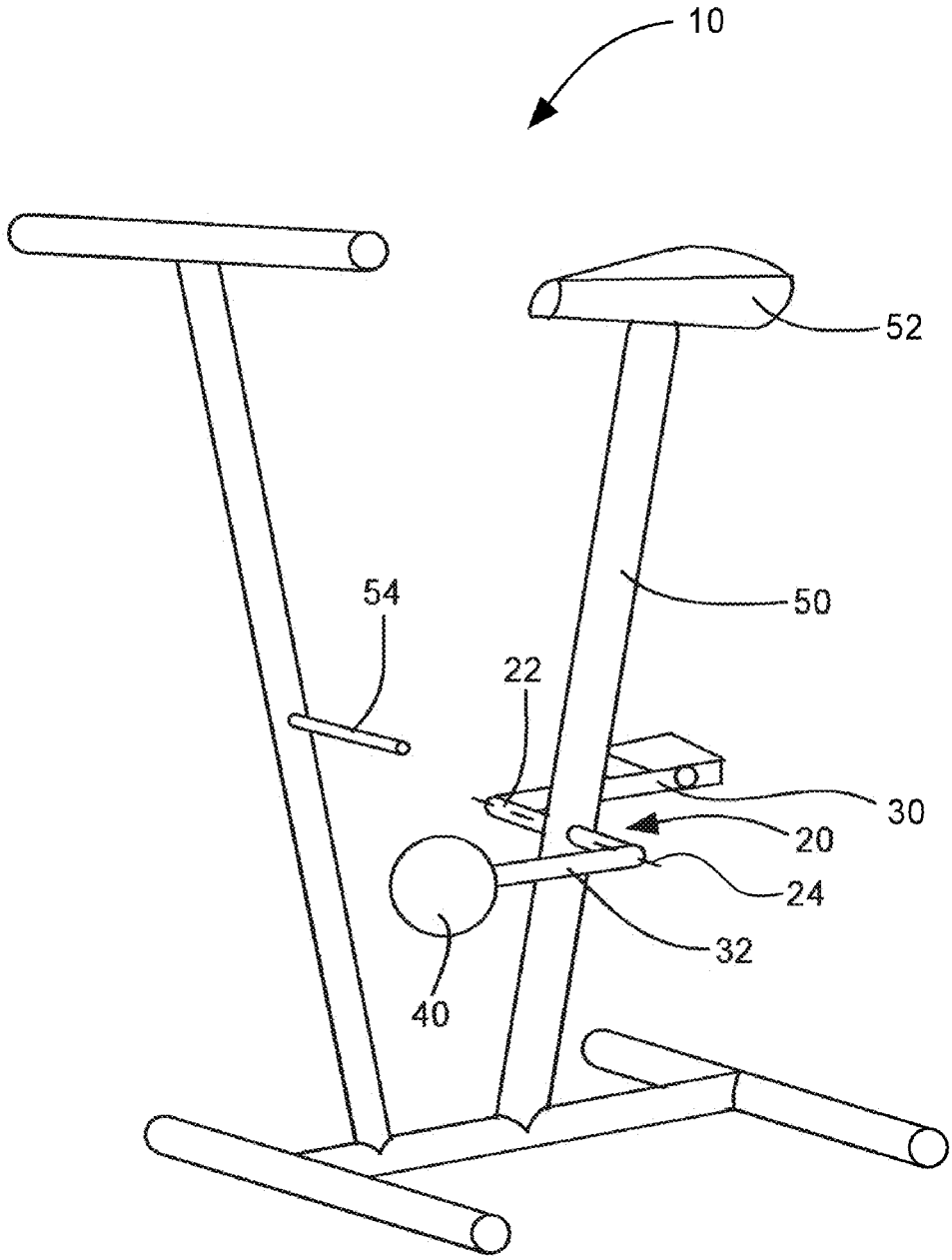
FIG. 3 shows a muscle device configured as an exercise bicycle.

With reference to FIG. 3, the present invention provides an exercise device 10 with which a subject can exercise primarily a single muscle group, such as the musculature associated with a single limb. Such a device can be utilized with one limb more efficiently and effectively than a conventional ergometer designed for tandem two-limb exercise. A device in accordance with the present invention can comprise a crank to which two arms are connected, where a first arm can be used to transmit to the crank an external force, such as can be applied to the device by the subject, while a second arm can be used to transmit to the crank a force supplied from an assist mechanism, and where both arms can transmit forces sufficient to cause the crank to rotate.

The crank 20 of the present invention can include a central axle 22. The axle can preferably be substantially cylindrical, though other cross-sectional shapes can be suitable such as, but not limited to, square, triangular, or star-shaped. Any cross-sectional shape that will allow the axle to rotate in its housing can be used in accordance with this invention. In a particular aspect, the axle can include a flywheel positioned at some point along the axle's length and concentric to the axle. The flywheel will preferably be substantially circular, though other shapes that do not interfere with the ability of the flywheel and axle to rotate can be used. An outer edge of the flywheel can be smooth, or it can include notches or protuberances by which the flywheel can be engaged by other devices such as belts, chains, sprockets, or latches. One specific example can include a flywheel having a toothed outer edge that engages a chain, which in turn communicates rotation of the flywheel to another component such as a wheel or generator. Further, the crank can have various contours which provide structural and/or aesthetic benefits.

The device 10 can also comprise a first arm 30 that is connected to the crank 20 at a point along its length, preferably near an end thereof, and can extend from the crank in a direction that is substantially perpendicular to the axis of rotation 24. In terms of its length, thickness, orientation, and other characteristics, the first arm should be configured so that a force applied to its distal end will transmit a torque to the crank sufficient to cause the crank to rotate. Typically, the force can be produced directly or indirectly by the subject employing the device.

The amount of force required to rotate an unencumbered crank of given size and mass will depend at least in part on the length of the first arm. While it should be apparent that the first arm can have many possible lengths in accordance with this invention, the minimum length should at least be such that a force generated by a human subject would result in rotation of an unencumbered crank. The length of the first arm can preferably be such as to allow an adult human subject to keep one of his or her limbs in contact with the distal end of the arm throughout a full rotation of the crank. In accordance with these considerations, the first arm can generally be from 2 inches to 36 inches, more particularly from 3 inches to 24 inches, and preferably from 4 inches to 10 inches in length.

The distal end of the first arm can be shaped in a way that facilitates the application of force to the arm by the subject. This can be accomplished by a right-angle bend of the distal end of the arm itself, or by an attachment to the arm. One example of an attachment is a foot-pedal such as is found on the crank of a conventional stationary bicycle. Those having skill in the art will recognize that any extension which extends outward substantially perpendicular to the body of the first arm and for a sufficient distance to allow a subject to grasp or step thereon can be utilized with the present invention. Additional components that facilitate the type of exercise involved here, such as one or more straps or commercial pedal binding systems to secure the limb to the first arm can also be used. Such straps or retainers can be beneficial to guide the limb along with the first arm. However, such straps are not generally intended to be used for forced upward motions. Specifically, the assist mechanism is designed to provide supplemental force sufficient to drive the first arm upward without substantial upward force using the associated limb.

The device 10 can also comprise a second arm 32 that is connected to the crank 20 and extends substantially perpendicular to the axis of rotation and in a substantially opposite direction from that of the first arm 30. Like the first arm, the second arm is configured to communicate torque to the crank and cause the crank to rotate. Therefore, according to one embodiment, the second arm can be essentially identical in shape and dimension to the first arm. However, the force applied to the second arm is supplied by an assist mechanism rather than the subject. The shape and dimension of the second arm for a given embodiment can depend on the nature of the assist mechanism used in that embodiment.

Devices in accordance with the present invention can include an assist mechanism by which a subject is allowed to exercise a single limb using a cyclical motion and forces which are similar to the motion used with paired-limb ergometers. One unique characteristic of the device disclosed here is that the subject need only exert himself for a portion of the cyclical motion. For example, a human subject using two legs in a pedaling motion on a paired-limb ergometer need only actively extend each leg in an alternating fashion to accomplish continuous rotation of the crank. The force needed to complete the flexion portion of the motion for each leg can be supplied by the extension of the opposite leg, so that flexion is primarily passive. However, because oxygen is preferably delivered at high rate to both legs, the potential gain in aerobic capacity for each leg is less than if exercised one at a time. If the subject used only one leg on a paired-limb ergometer, he would need to both actively extend the limb and flex the limb to accomplish continuous rotation. The muscles used to flex the leg are typically more easily fatigued in humans, so this manner of use would result in rapid fatigue and therefore less benefit. In contrast, with the device provided by the present invention, the force needed to complete the flexion portion of the motion for the exercising leg is supplied by the assist mechanism. Therefore, the subject can gain the benefit of two-legged cycling, i.e. exercising for a longer period of time with less fatigue, while also reaping the benefit of single-leg cycling, i.e. a higher rate of oxygen delivery to the exercising leg.

In one embodiment of the present invention, the assist mechanism is a counterweight 40, with respect to the first arm 30, which is connected to the second arm 32 via the central axle 22. In this configuration, no balanced counterweight is connected to the first arm such that the weight distribution across the central axle is highly asymmetric and weighted towards the second arm. The counterweight can assist in rotating the crank during a portion of the rotation cycle, e.g. during limb flexion, by virtue of the momentum imparted to the counterweight during another portion of the rotation cycle, e.g. limb extension, and also by the effect of gravity. Therefore, it should be recognized that the minimum weight of the counterweight should be enough so as to achieve the momentum needed to rotate the crank. Those having skill in the art will be aware that the weight needed will depend on a number of factors, such as the force applied to the first arm by the subject, the length of the second arm, the radius of the crank, and the strength of the subject. In general, the counterweight can weigh from about 5 pounds to about 70 pounds. More particularly, it can weigh from about 10 pounds to about 50 pounds. According to a still more particular embodiment, the counterweight can weigh from about 20 pounds to about 40 pounds.

With reference to FIGS. 5*a*-5*d*, a counterweight may be configured in a variety of ways. According to one embodiment, illustrated for example in FIGS. 5*a*-5*c*, the counterweight 42, 44, 46 can be constructed from a single solid piece of material, such as iron, steel, lead, or other dense material. In an alternative embodiment, illustrated in FIG. 5*d*, the counterweight 48 can be a hollow container with an opening 64 through which it can be filled. The counterweight could be given a desired weight by filling it with a sufficient amount of filler material. Examples of suitable filler material can be water, sand, gravel, or steel pellets. In one embodiment, illustrated in FIG. 5*a*, a counterweight 42 may be spherical in shape. In another embodiment, illustrated in FIG. 5*b*, a counterweight 44 may be cuboid in shape. In yet another embodiment, illustrated in FIG. 5*c*, a counterweight 46 may be combined with a pedal 60. In this embodiment, a counterweight may be integral to a pedal or removably attached to a pedal. This embodiment may allow a person to exercise a limb that is relatively weak compared to the other limb.

Figure 7:
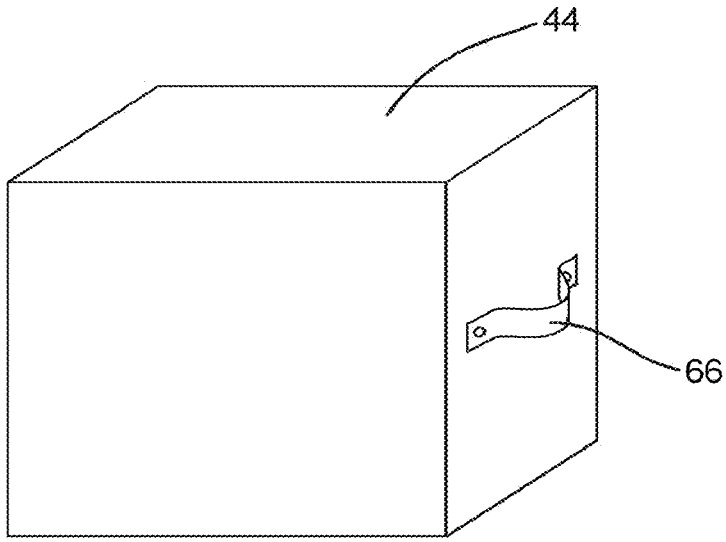
FIG. 7 shows an embodiment of a clamp for attaching a counterweight to an arm of a crank.

The counterweight can be configured to attach to the second arm by any of a number of mechanisms, either permanent or temporary. In one embodiment, the counterweight can be attached by an interference fitting. An interference fitting may be such that a protrusion from, or attached to, a counterweight may be slightly larger than a mating engagement hole in a second arm, or vice versa. Attachment may result from the tight fit between the protrusion and the hole. In an alternative embodiment, the counterweight can be configured to attach by a threaded fastener 62. In another alternative embodiment, illustrated in FIG. 7, the counterweight can be attached to the second arm by a clamp 66. Using a removable attachment has the advantage of allowing a single device to be usable with a limb on either side of a subject's body. To switch from exercising one limb to exercising the opposite limb simply involves replacing the counterweight from one arm with the pedal (or equivalent component) from the other arm, and vice versa. This approach would be most suited to embodiments where the first arm and second arm are essentially identical.

Other components or mechanical arrangements can exist that serve as a secondary assist mechanism. A secondary assist mechanism can comprise a pneumatic system, where the force supplied to the crank during a portion of its cycle comes from the expansion of a compressed gas. In a more particular aspect, the compression of the gas can be accomplished by a force supplied by the subject. Alternatively, the assisting force can be supplied by a spring mechanism, where the spring is tensioned during part of the rotation cycle and the subsequent release of that tension drives a portion of the rotation cycle. Still another alternative can involve a motor operatively connected to the crank and configured to provide torque thereto during the appropriate portion of the rotation cycle. The present invention is intended to encompass any such variation that serves to assist in a portion of the crank rotation cycle so as to allow an efficient mode of exercise such as described above.

Figure 6:
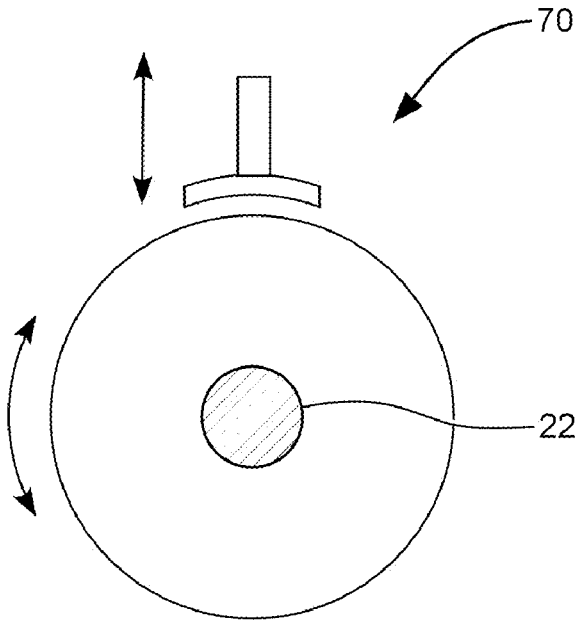
FIG. 6 shows an embodiment of a brake.

In a particular embodiment, illustrated in FIG. 6, the device can further comprise a brake 70 operatively connected to the crank 22 and configured to resist the rotation of the crank. The brake can be used to prevent the crank from turning, and thereby securing the device for periods of nonuse. Alternatively, the brake can be used only to make it more difficult to rotate the crank, thereby providing a resistance mechanism to increase the intensity of exercise. Such a brake can operate via surface-to-surface friction by pressing a friction material against the crank or flywheel to generate the friction. This can be accomplished using calipers or a brake pad for example, where the braking surface is covered with rubber or other composite material. It is also possible that the assist mechanism can function as a brake in accordance with the present invention. Typically, this will involve utilizing inertia to generate friction, such as the inertia present in the components of a motor or in a counterweight. A number of braking mechanisms for ergometers and moving bicycles are known in the art, and one with skill in the art will recognize those that can be used with the present invention. Additional non-limiting examples of suitable braking mechanisms can include magnetic, electrical, fluid, and aerodynamic resistance mechanisms.

Figure 4:
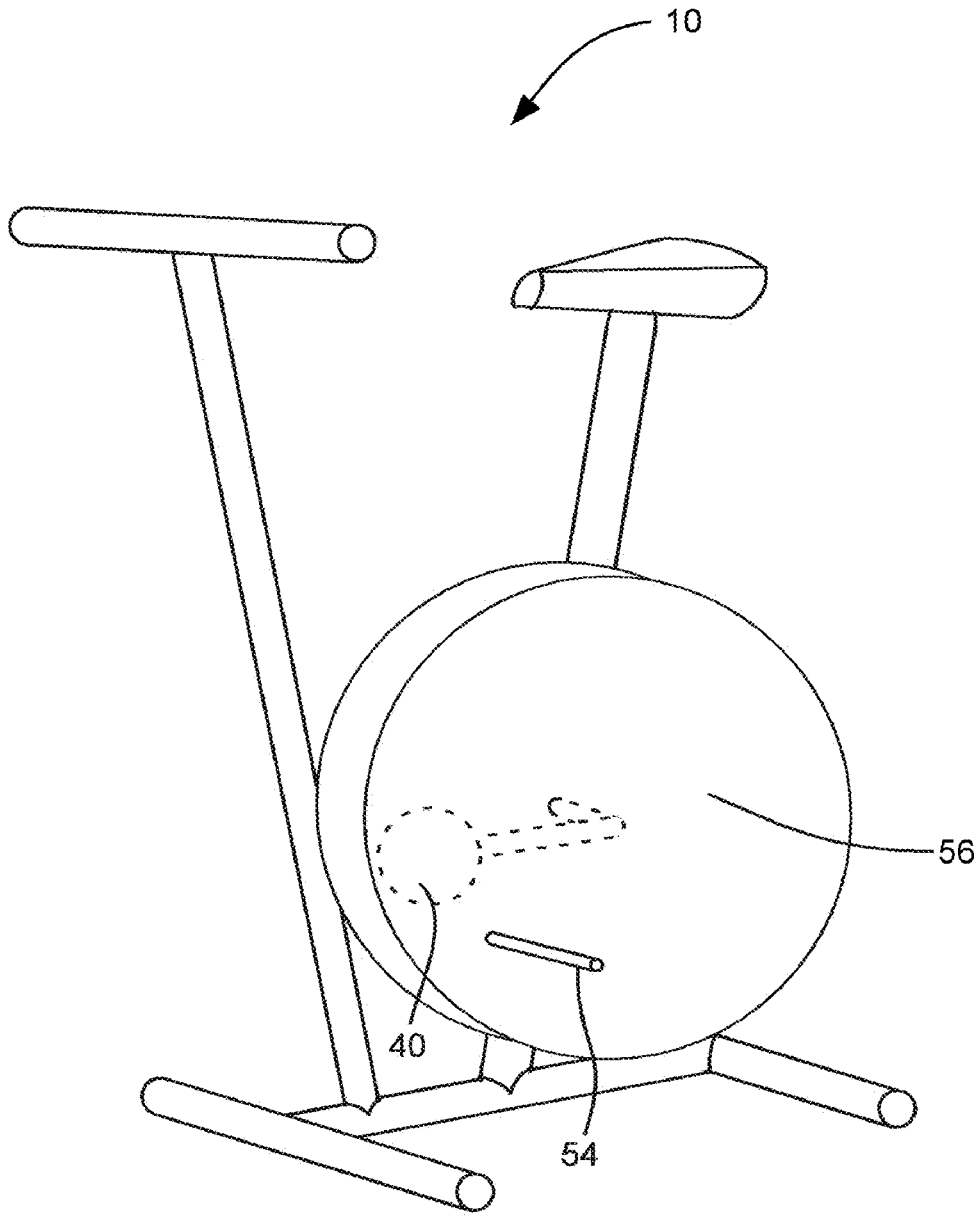
FIG. 4 shows an embodiment of a muscle device configured as an exercise bicycle that incorporates a shield.
Figure 5A:
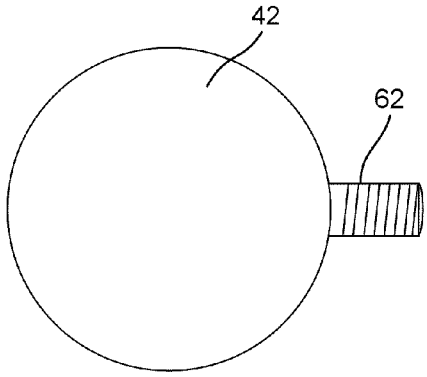
FIG. 5*a* shows an embodiment of a counterweight configured as a spheroid.
Figure 5B:
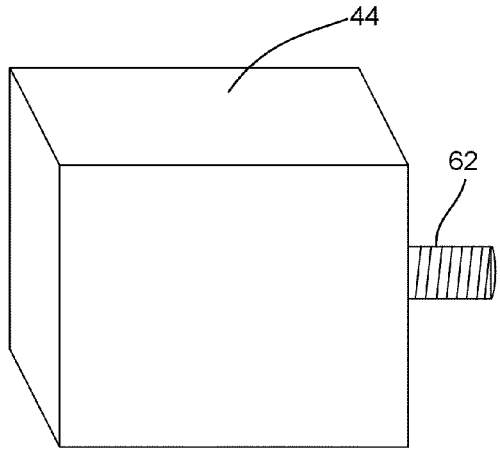
FIG. 5*b* shows an embodiment of a counterweight configured as a cuboid.
Figure 5C:
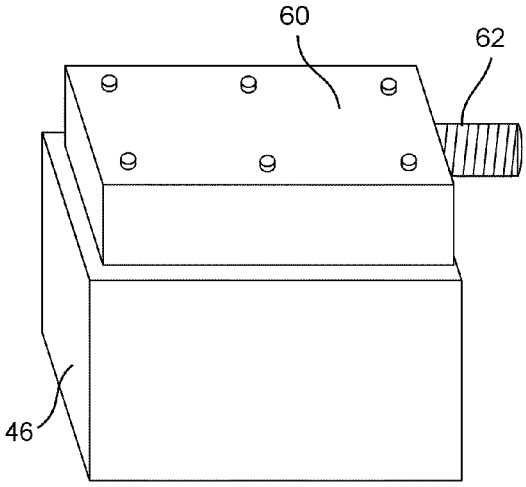
FIG. 5*c* shows an embodiment of a counterweight configured to be combined with a pedal.
Figure 5D:
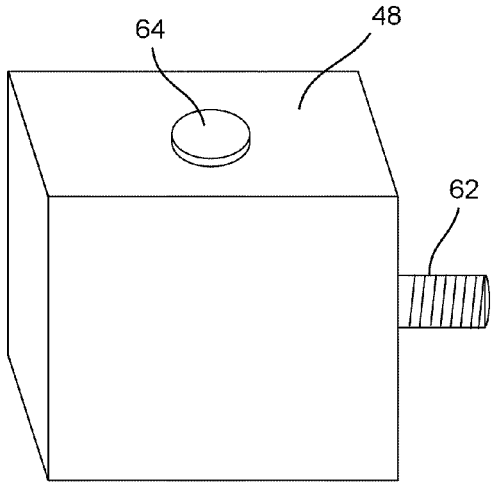
FIG. 5*d* shows an embodiment of a counterweight configured as a hollow container with an opening through which it can be filled.

A typical paired-limb ergometer can be modified to operate as a single-limb ergometer in accordance with this invention. To do so involves removing one pedal or crank arm from the ergometer and replacing it with a counterweight having a suitable connector. Therefore this invention also provides a retrofit kit for use in making such a modification. Such a kit can comprise a counterweight and a fastener configured for attaching the counterweight to an arm of an ergometer. Preferably the fastener used will allow the counterweight to be removed and remounted as needed. As an additional aspect, illustrated in FIG. 4, the counterweight can be isolated, positioned and shaped so as to prevent striking the subject during use. More particularly, a safety wall or other type of shield 56 may be situated so as to isolate the counterweight from the limbs of the subject, allowing the counterweight to freely rotate during use while preventing it from striking the subject. A shield may enclose all or a portion of a region encompassing the path of a rotating counterweight and second arm. In one embodiment, a shield may be a fender-shaped guard along the top of a region encompassing a rotating counterweight and a second arm. Alternatively, a crank may extend a counterweight away from a frame to create a space between the plane of motion of the counterweight and the frame. This configuration may be used to provide space for a person using the device to hang or rest a leg next to the frame but inside the plane of motion of the counterweight. In this configuration, a suitable shield may resemble a disc that is located between the plane of motion of the counterweight and the region where a person may rest a leg. Further, such retrofit kits can also include written installation instructions corresponding to a particular model or configuration of exercise device to be modified. The written instructions can include directions tailored for a particular installation, depending on the type of fastening used. Optionally, the retrofit kit can include a suitable tool which can be used to remove an existing pedal and/or install the counterweight. Non-limiting examples of a suitable tool can include Allen wrench, fixed wrench, screwdriver, and the like.

A common setup used for stationary cycling exercise involves the use of a bicycle trainer. This approach is often used to facilitate stationary exercise on a road bicycle, thereby providing a riding experience that more closely resembles actual road riding than is possible with conventional stationary exercise bicycles. Bicycle trainers usually comprise a stationery structure upon which a bicycle may be mounted and may have various configurations depending on the desired features and type of bicycle. For example, a road bicycle may be mounted so that the rear wheel of the bicycle is in contact with the trainer rather than the ground. Alternatively, the rim of the rear wheel can be contacted as in the case of many mountain bike trainers. Trainers typically feature mechanisms to apply resistance to the rear wheel of the bicycle, so as to simulate riding under different conditions, such as climbing a hill. A retrofit kit as described above may be used to modify a bicycle for use on a bicycle trainer, so that the benefits of single-leg cycling may be enjoyed in combination with the benefits arising from bicycle trainers.

As discussed above, exercise bicycles constitute one form of ergometer, but can also include free road bicycles. Accordingly, one aspect of the present invention provides an exercise bicycle, with embodiments illustrated in FIGS. 3 and 4. Such a bicycle comprises a frame 50 and a crank to which at least two arms are connected, where a first arm transmits to the crank an external force, such as can be applied to the device by the subject, while a second arm transmits to the crank a force supplied from an assist mechanism. The frame may be any structure configured to support a subject using the bicycle, as well as providing attachment points for apparatuses that facilitate use of the device. Such apparatuses include conventional bicycle parts, such as a seat 52 on which a subject may sit or recline, and handlebars or an equivalent structure to serve as a handhold and to provide support to the subject's upper body. As discussed above, the crank of such a bicycle is caused to rotate by forces applied to the arms connected thereto, where the subject exerts a downward force to the first arm by extension of one leg while an assist mechanism provides a force to the second arm. In a preferred embodiment, the crank and arms are configured as a pedal assembly. The assist mechanism is preferably a counterweight that is operatively connected to the second arm. In general, the counterweight can weigh from about 5 pounds to about 70 pounds. More particularly, it can weigh from about 10 pounds to about 50 pounds. According to a still more particular embodiment, the counterweight can weigh from about 20 pounds to about 40 pounds. The exact weight may vary depending on the particular user and desired exercise conditions, but should generally be sufficient to affect a power curve during use which substantially corresponds to non-assisted motion at the same rotational velocities. Thus, the return assist mechanism of the present invention is a passive assist mechanism rather than an active assist mechanism such as electric motors, hydraulic arms, or the like.

A particular embodiment of the exercise bicycle further comprises a foot rest 54 configured such that a subject using the bicycle may place one foot upon the foot rest while maintaining contact between the other foot and the first arm through a complete rotation of the crank. In one aspect of this embodiment, the foot rest includes a retaining mechanism to allow the foot to be secured to the foot rest. Any suitable retaining mechanism can be used in connection with the present invention. These include structures into which a foot may be inserted, such as straps, stirrups, toe clips, or the like. Such systems have the advantage of not requiring a subject to wear specialized footwear. Alternatively, other structures may be used, such as clipless (e.g. commercial pedal binding systems) pedal systems in which a fastener is designed to positively connect with a complementary structure on the sole of a specialized shoe. A foot rest may also be part of the retrofit kits described above. In this case, the foot rest may be configured to attach to the frame of a road bicycle or exercise bicycle. In another embodiment, a footrest may be configured to attach to a stationary shield 56. One important aspect of a foot rest is to keep the foot and leg safely out of the way of the moving counter weight.

The present invention also provides methods for exercising the musculature associated with a single limb that can impart greater gains in muscle strength and aerobic capacity than analogous paired-limb exercise. In one embodiment, a method of exercise can include applying a substantially downward force to an arm that is operatively connected to a crank, such as a first arm as described above, so that the crank rotates accompanied by downward movement of the arm. This movement corresponds to the extension of the limb used to apply the force. The crank is then allowed to continue rotating, carrying the arm (and typically the extremity of the limb) eventually upward. This is accompanied by flexion of the limb; however, this portion of the rotation cycle and the resulting flexion are assisted by an assist mechanism such as those discussed above. In a particular embodiment, the assist mechanism is a counterweight. As a result, little or no external force (such as from flexor muscles of the limb) is needed to effect this portion of the rotation cycle. Accordingly, the methods and devices of the present invention allow for dramatically improved biomechanical motion which approximates forces experienced under normal paired cycling while reserving oxygen capacity for a single limb. Typically, an assisted power curve during cycling of the device substantially corresponds to a non-assisted power curve when each is measured at a common rotational velocity. FIG. 1 (explained in more detail below) is a common example of this correspondence between assisted and non-assisted motion. Preferably, deviation at maximum extension and deviation at maximum flexion between the assisted power curve and the non-assisted power curve are each less than about 75%, and preferably less than about 50%. Most preferably, the deviation at maximum extension is less than 10%. "Deviation" is defined as the percent difference between the non-assisted power and the assisted power divided by the non-assisted power. Similarly, $CO_2$ consumption for single limb exercise can be substantially identical to paired-limb exercise at the same power for a particular subject. Typically, assisted $CO_2$ consumption can deviate from non-assisted $CO_2$ consumption by less than 20%, and preferably less than about 10%.

The methods of the present invention, particularly embodiments which comprise application of substantially downward forces by a subject, are especially suited to exercising the human leg, where the subject is positioned higher than the crank. However, it should be understood that the method can also be used where the subject is positioned differently, e.g. prostrate, recumbent, or supine, and also for exercising other body parts such as an arm. For those modes of exercise, the directionality of applied force and assisting force can differ yet remain in accordance with the present invention.

The following example illustrates one embodiment in accordance with the present invention. However, it is to be understood that the following is only exemplary or illustrative of the application of the principles of the present invention. Numerous modifications and alternative compositions, methods, and systems can be devised by those skilled in the art without departing from the spirit and scope of the present invention. The appended claims are intended to cover such modifications and arrangements. Thus, while the present invention has been described above with particularity, the following Examples provide further detail in connection with several specific embodiments of the invention.

EXAMPLES

A comparison was made of force and metabolic data measurements taken from a human subject when using (a) a conventional exercise bicycle, and (b) an exercise bicycle device designed for single-leg exercise according to the present invention. The single-leg exercise device was equipped with a 30 lb. counterweight on the pedal on the side opposite the leg being exercised (termed the "off-leg" side). As shown in FIG. 1, the power and associated forces on the on-leg pedal throughout the pedal cycle were substantially similar on the conventional exercise bicycle and the single-leg exercise bicycle. This indicates that, in single-leg pedaling, the counterweight contributed to pedal rotation very much like the subject's off-leg did in conventional paired-leg pedaling. One important result of such performance is that it provides for passive flexion of the exercised leg while still producing normal pedal rotation. This is important in avoiding excessive fatigue and can allow for extended exercise of specific muscles. In contrast, when single leg cycling was performed without the counterweight, power was reduced during the extension phase and increased during the flexion phase. Thus, single leg cycling without a counterweight is biomechanically different than normal two-legged cycling, whereas single leg cycling with a counterweight in accordance with the present invention is quite similar to normal two-legged cycling.

Figure 2:
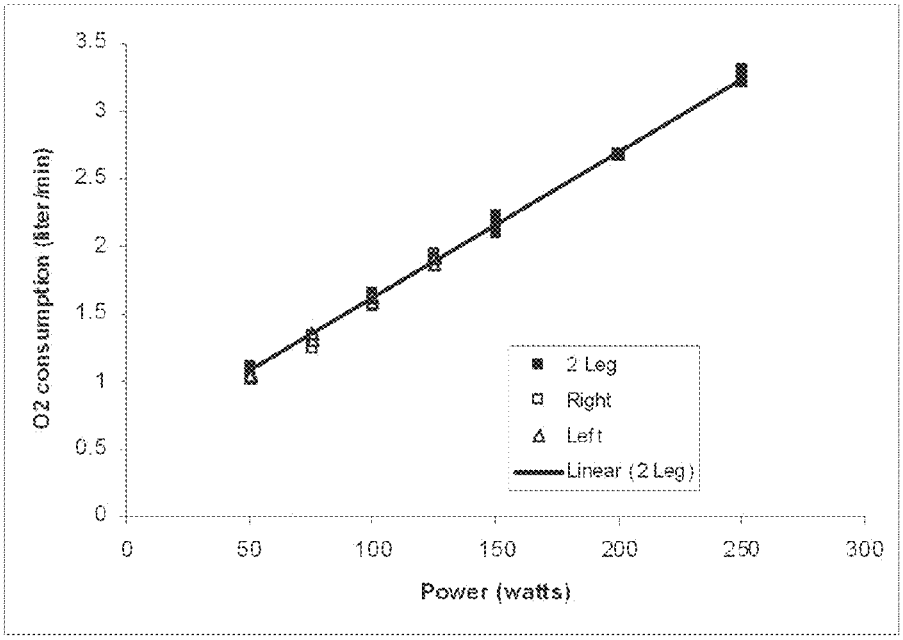
FIG. 2 shows the oxygen consumption as a function of power in a human subject on an exercise bicycle during conventional paired-limb pedaling and single-leg pedaling assisted by a 30-lb counterweight in accordance with an embodiment of the present invention.

FIG. 2 shows the metabolic rate measurements taken from the subject while pedaling each of the two devices. As the figure shows, oxygen consumption was linearly related to power output for single and double-leg cycling. Further, the oxygen uptake for single leg cycling lies on the regression line from the double-leg data. Thus, the counterweighted device allows steady state submaximal cycling, to be performed with the similar efficiency and metabolic cost as normal two legged-cycling.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

It is to be understood that the above detailed description is only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A muscle exercise device, comprising:

(a) a crank having an axis of rotation;

(b) a first arm connected to the crank and extending substantially perpendicular from the axis of rotation, configured so that a downward external force applied to a distal end of the first arm causes rotation of the crank;

(c) a second arm connected to the crank and extending substantially perpendicular from the axis of rotation in a direction substantially opposite to that of the first arm; and (d) a counterweight with respect to the first arm to assist in rotating the crank, operatively connected and removably attached to the second arm by a removable attachment and weighing from 5 to 70 pounds, and wherein the first arm does not have a removable attachment for a second counterweight so as to provide an asymmetric weight distribution across the crank that is weighted toward the second arm.

2. The device as in claim 1, further comprising a brake operatively connected to the crank and configured to resist rotation of the crank.

3. The device as in claim 1, wherein the counterweight comprises lead.

4. The device as in claim 1, wherein the counterweight comprises iron.

5. The device as in claim 1, wherein the counterweight comprises a hollow container having an interior and at least one sealable opening providing access to the interior.

6. The device as in claim 1, wherein the counterweight has a weight of about 20 to 40 pounds.

7. The device as in claim 1, wherein the counterweight is connected to the second arm by a threaded fastener.

8. The device as in claim 1, wherein the counterweight is connected to the second arm by an interference fit.

9. The device as in claim 1, wherein the counterweight is connected to the second arm by a clamp.

10. The device as in claim 1, wherein the muscle exercise device is an exercise bicycle.

11. The device as in claim 1, further comprising a secondary assist mechanism operatively coupled to the crank.

12. The device as in claim 1, further comprising a frame retaining the crank in a fixed position and including a seat coupled thereto in a position suitable for use in extension and flexion motion of legs of a subject.

13. The device as in claim 1, further comprising a foot rest attached thereto, said foot rest having an upper surface and a lower surface, and being configured so that a first foot of an exercising subject can rest on the upper surface while a second foot of the subject is in operative contact with the first arm.

14. The device as in claim 1, further comprising a stationary shield situated lateral to the counterweight and configured to prevent the counterweight from striking an exercising subject.

15. The device as in claim 1, wherein the second arm and counterweight does not include a foot support.

* * * * *